US005590868A

United States Patent [19]

Hebert et al.

[11] Patent Number: 5,590,868

[45] Date of Patent: Jan. 7, 1997

[54] HAMMER HAVING A GRIPPING SURFACE WITH RECESSES

[76] Inventors: Paul W. Hebert, 6450 Lakeshore Dr., San Diego, Calif. 92119; Ted Floyd, 453 Grand Ave., Spring Valley, Calif. 91977

[21] Appl. No.: 562,468

[22] Filed: Nov. 24, 1995

[51] Int. Cl.[6] ..... B25C 11/00

[52] U.S. Cl. ..... 254/26 R; 81/20; 81/23

[58] Field of Search ..... 254/18, 19, 26 R, 254/26 E; 81/20, 21, 22, 23, 24, 25, 26, 27

[56] References Cited

U.S. PATENT DOCUMENTS 2,906,150 9/1959 Stewart ..... 81/20

4,336,832 6/1982 Poulos ..... 81/20

4,890,518 1/1990 Floyd ..... 81/20

5,062,324 11/1991 Saviano ..... 81/20

*Primary Examiner*—Bruce M. Kisliuk

*Assistant Examiner*—Thomas W. Lynch

*Attorney, Agent, or Firm*—Charles C. Logan, II

[57] ABSTRACT

A hammer having a handle connected to the bottom end of the hammer head assembly. The hammer head assembly has a claw portion, a central portion, a head portion and a relieved connecting portion between the head portion and the central portion. The head portion has a flat top wall surface. The front surface of the head portion has a plurality of recesses formed therein with no protrusions extending outwardly from the front surface. The recesses cover at least 30 percent of the surface. The recesses may be aligned in rows and columns and they provide a better gripping surface when they strike the head of a nail.

7 Claims, 1 Drawing Sheet

HAMMER HAVING A GRIPPING SURFACE WITH RECESSES

BACKGROUND OF THE INVENTION

The invention relates to a hammer and more specifically to one that has novel structure on the front surface of its head portion.

Presently a serrated design is applied to the front surface of many hammer heads or other striking tools. It's purpose is for gaining better gripping on the striking surface of an object such as the top of the head of a nail as it is struck. The objective is to keep the head of the hammer from slipping from side to side on the head of a nail and thereby achieve a uniform striking force.

One of the problems with the protruding serrated design is that it bites into the object struck (such as a nail). This causes tears and indentations of the serrated design into the top surface of the nail. Also when the hammer happens to strike surfaces other than the top of the nail the indentation of the design are imprinted on the surface.

The points or protrusions of the hammer face dig into the head of the nail because the hammer head has a higher Rockwell hardness than the object struck. The head of these hammers has had material removed or machined from their front surface to form these protrusions. They break off in time after repeated use or they may mash flat. This may gum up the front surface of the hammer and it becomes slick, thereby aborting the objective of the serration. Either of these occurrences is a potential hazard. One thing that might happen is a minor finger accident caused by the slipping of the head of the hammer off the nail. Another would be injury caused by a flying bit of the protrusion from the serrated design when it breaks off. Practically all framing hammers have serrations on the front surface of the hammer's head.

It is an object of the invention to provide a novel hammer having the front of its head portion configured to provide a better gripping surface to engage the head of a nail.

It is also an object of the invention to provide a novel front surface for the head portion of a hammer that eliminates protrusions that may break off and cause injuries.

It is another object of the invention to provide a novel front surface for the head portion of a hammer that does not have protrusions that are mashed flat or that gum up the front surface of the head portion.

It is an additional object of the invention to provide a novel front surface for the head portion of a hammer that is economical to manufacture and market.

SUMMARY OF THE INVENTION

The novel hammer has been designed with the head portion of the hammer head assembly covered with a plurality of recesses or indentations formed in its front surface. The indentations in this particular design are round resembling the surface of a golf ball. The improved gripping surface is achieved by the fact that the object being struck (the nail) is softer so that the material of its head enters the round indentations of the hammer face which is harder. The action of the top surface of the nail conforming to the indentations in the face of the hammer achieves a better gripping surface. This eliminates the tendency of the hammer head glancing or slipping off the head of the nail as it is being pounded. Also eliminated are the protrusions that have had a tendency in the past to break off and fly into the air, often times causing injury to the worker or someone in the vicinity of the worker.

DESCRIPTION OF THE PREFERRED EMBODIMENT

Figure 1:
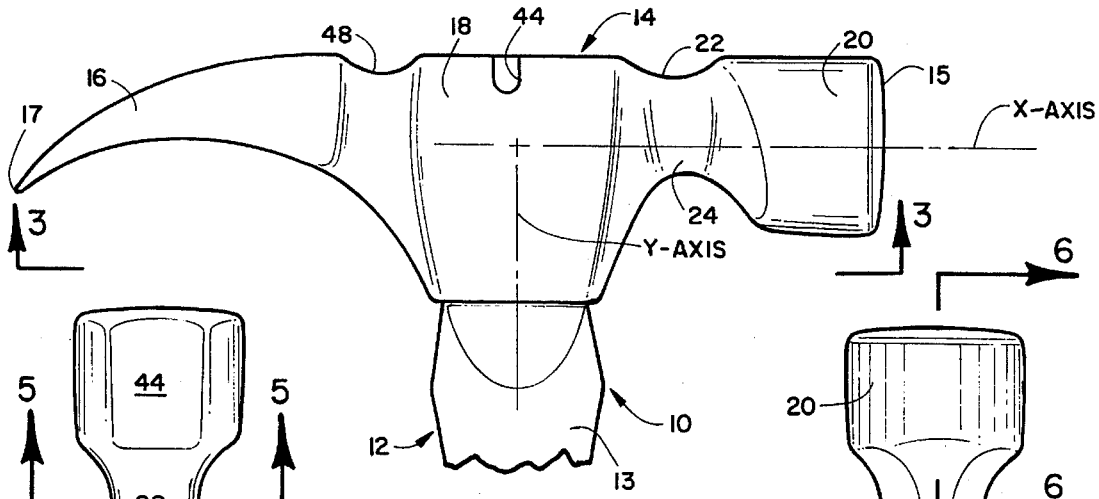
FIG. 1 is a partial side elevation view of the top portion of the novel hammer.
Figure 2:
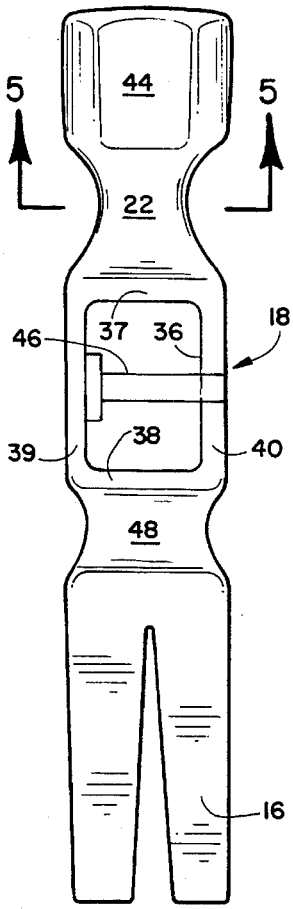
FIG. 2 is a top plan view of the novel hammer.
Figure 3:
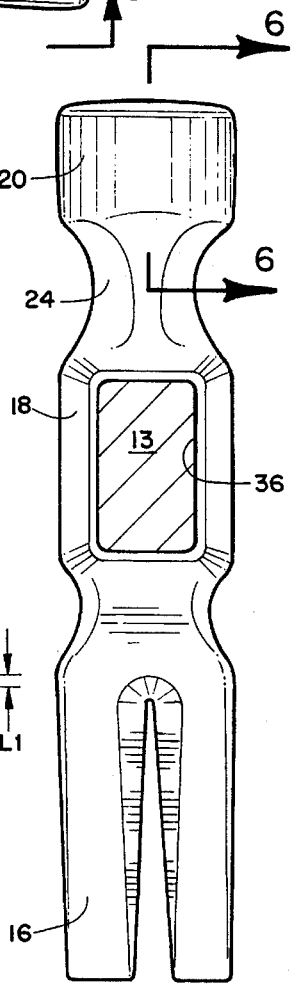
FIG. 3 is a cross sectional view taken along lines 3—3 of FIG. 1.
Figure 4:
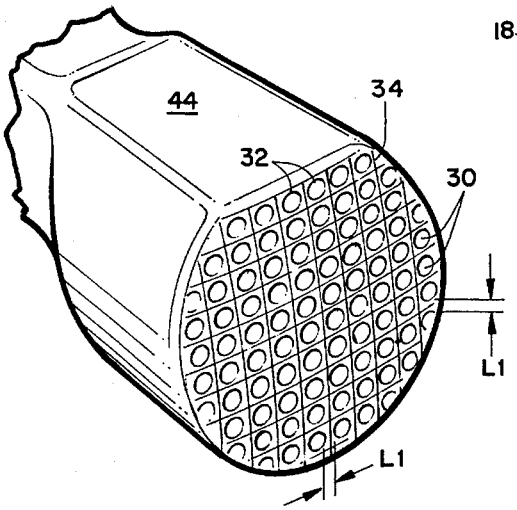
FIG. 4 is a partial front perspective view of the novel hammer head assembly.
Figure 5:
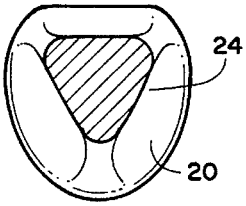
FIG. 5 is a cross sectional view taken along lines 5—5 of FIG. 2.
Figure 6:
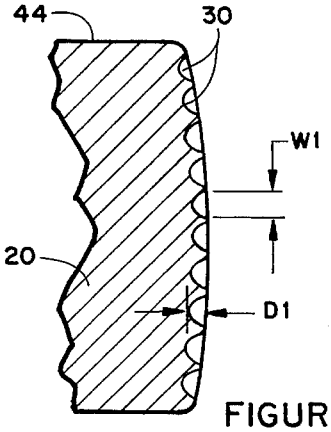
FIG. 6 is a cross sectional view taken along lines 6—6 of FIG. 3.

Applicant's novel hammer will now be described by referring to FIGS. 1–6 of the drawing. The hammer is generally designated numeral 10. It has a handle 12 having a shank portion 13 and a hammer head assembly 14.

Hammer head assembly 14 has a front end 15, a rear end 17, a claw portion 16, a central portion 18 and a head portion 20. A rounded indentation 22 is formed between the top surface of head portion 20 and central portion 18. Rounded indentation 22 is part of the relieved connecting portion 24 between central portion 18 and head portion 20. Relieved connecting portion 24 has a triangularly shaped cross section.

Head portion 20 has a longitudinally extending X-axis that intersects the longitudinally extending Y-axis of handle 12 at the center of gravity of the hammer. The front surface of head portion 20 is substantially flat and it has a plurality of indentations 30 covering at least 30 percent of the front surface. These recesses have a width W1 in the range of 0.050–0.200 inches. The recesses also have a depth D1 in the range of 0.050–0.200 inches. The spacing between the individual recesses is L1 and this distance is in the range of 0.030–0.200 inches. The recesses may be formed in aligned columns 32 and rows 34.

Central portion 18 has a bore hole 36 extending from its top surface to its bottom surface and it is substantially rectangular. It has a front wall 37, a rear wall 38, and left and right side walls 39 and 40. Neck portion 13 of handle 12 is fixedly received in bore hole 36. Head portion 20 has a flat top wall 44 that along with the top surface of central portion 18 allows the hammer to be stood upright on these surfaces. A T-shaped slot 46 is formed in the top end of the neck portion 13 of handle 12 for receiving a nail. It is aligned with nail receptacle groove 44.

A rounded indentation 48 is formed between the top surface of central portion 18 and claw portion 16 so that the head hammer assembly may be rested on a block or cat's paw for extra leverage.

What is claimed is:

1. A hammer comprising:

an elongated handle having a longitudinally extending Y-axis, a top end, a neck portion and a shank portion;

a hammer head assembly having a front end, a rear end, a head portion, a central portion, and a relieved connecting portion between said head portion and said central portion;

said central portion having a top surface, a bottom surface and a substantially rectangular bore hole that extends from said top surface to said bottom surface and the neck portion of said handle is received therein; said central portion having a front wall, a rear wall and laterally spaced side walls surrounding said bore hole;

said head portion having a front surface and a longitudinally extending x-axis perpendicular to the front surface; a plurality of separate indentations that are not interconnected to each other formed in said front surface; said indentations cover at least 30 percent of said front surface, the depth of said indentations being in the range of 0.050–0.200 inches and the width of said indentations being in the range of 0.050–0.200 inches.

2. A hammer as recited in claim 1 wherein the indentations are separated from each other a distance in the range of 0.030–0.200 inches.

3. A hammer as recited in claim 1 wherein said hammer head assembly has a claw portion.

4. A hammer as recited in claim 1 wherein one of the side walls of said central portion has a nail receptacle groove adjacent its top surface.

5. A hammer as recited in claim 1 further comprising a rounded indentation between said central portion and said claw portion so that said hammer head assembly may be rested upon a block or cats paw for extra leverage.

6. A hammer as recited in claim 1 wherein said head portion has a flat top wall surface.

7. A hammer as recited in claim 1 wherein said relieved connecting portion between said head and said central portion has a substantially triangular cross section.

* * * * *